United States Patent [19]

Barnett

[11] Patent Number: 4,566,058

[45] Date of Patent: Jan. 21, 1986

[54] BOOM SUPPORTED LIGHT FIXTURE

[76] Inventor: Norton C. Barnett, 23570 Ironwood Dr., Elkhart, Ind. 46516

[21] Appl. No.: 628,811

[22] Filed: Jul. 9, 1984

[51] Int. Cl.[4] ..... F21S 1/02

[52] U.S. Cl. ..... 362/430; 362/404; 362/406

[58] Field of Search ..... 362/404, 406, 147, 430, 362/432, 285

[56] References Cited

U.S. PATENT DOCUMENTS

| | | | |
|---|---|---|---|
| 1,195,262 | 8/1916 | Peirce | 362/430 |
| 1,202,745 | 10/1916 | Lindner . | |
| 1,714,003 | 5/1929 | Deach | 362/430 |
| 1,796,994 | 3/1931 | Husted | 362/430 |
| 1,938,237 | 12/1933 | Wagenhorst | 362/147 |
| 2,265,792 | 12/1941 | Allen | 362/430 |
| 3,010,013 | 11/1961 | Gunther et al. | 362/147 |
| 3,193,674 | 7/1965 | Fleming | 362/430 |
| 3,240,925 | 3/1966 | Paschke et al. . | |
| 3,576,988 | 5/1971 | Henning . | |
| 3,599,922 | 8/1971 | Junginger . | |
| 3,707,624 | 12/1972 | Marsh | 362/430 |
| 3,923,482 | 12/1975 | Knab et al. . | |
| 4,096,554 | 6/1978 | Greene . | |
| 4,097,919 | 6/1978 | Bobrick et al. . | |
| 4,232,357 | 11/1980 | Dietz | 362/430 |
| 4,280,167 | 7/1981 | Ellett . | |
| 4,288,844 | 9/1981 | Fisher et al. . | |
| 4,319,314 | 3/1982 | Morton . | |
| 4,437,144 | 3/1984 | Guenther | 362/430 |

*Primary Examiner*—Ira S. Lazarus

*Attorney, Agent, or Firm*—Albert L. Jeffers; Anthony Niewyk

[57] ABSTRACT

A lightweight and inexpensive boom supported light fixture is provided comprising a swivel connected to a support surface and being pivotally connected to one end portion of a boom assembly, and an illuminating device adjustably movable along the length of the boom assembly to provide illumination at selected areas. A holding mechanism at the remote end portion of the boom assembly selectively and positively holds the boom assembly at the desired location, and a control line downwardly disposed from the boom assembly permits the user to easily and conveniently position the assembly to provide illumination at a desired location.

17 Claims, 8 Drawing Figures

BOOM SUPPORTED LIGHT FIXTURE

BACKGROUND OF THE INVENTION

This invention pertains to a light fixture, and more particularly to an inexpensive and lightweight boom supported light fixture for providing illumination at selected areas of a working space.

Various types of overhead illuminating devices are currently available, and particularly in the medical field for surgical or other operations. In the medical field, these overhead illuminating devices are generally quite complex in design and structure since they usually include different types of articulative arm assemblies for supporting a plurality of light fixtures. In addition to being quite complex, these overhead illuminating devices are generally expensive to manufacture and purchase, and because of their heavy and bulky structure are quite difficult for one individual to assemble and install. These features are particularly disadvantageous to a user who only requires a simple and inexpensive means of providing illumination about a working space, for example, a typical home garage or basement working area.

Other types of overhead illuminating devices include a track assembly mountable on a surface, for example, a ceiling, and to which a lighting device is connected, thereby permitting the light fixture to be moved along the track assembly to various areas. This type of overhead illuminating device is difficult to assemble and install because of the track assembly. Further, some of these devices do not provide a convenient way of moving the device around except by hand, or possibly a pole or the like if the device is mounted on a high ceiling.

Still other types of overhead illuminating devices include those having a single telescopable arm for supporting a light fixture at one end and which are connected at its opposite end to some type of pivot device. A disadvantage with these types of devices is that dust and other foreign particles can collect about the movable portions of the telescopable arm, thereby eventually making it quite difficult, if not impossible, to telescopably operate the arm.

In view of the above, it is apparent that there is still a need for a boom supported light fixture that is lightweight and inexpensive to manufacture, and easily assembled and installed in the working spaces of a typical home garage or basement.

SUMMARY OF THE INVENTION

The present invention provides a solution to the aforementioned problems and disadvantages by providing a boom supported light fixture that is lightweight and inexpensive to manufacture, and is further easily assembled and installed in one's home garage or basement working area.

The present invention provides a boom assembly made of a lightweight material, such as aluminum or the like, and includes a relatively elongate frame member pivotally attached at one end thereof to a swivel mechanism connected to a surface, such as the ceiling or other overhead structure in a typical home garage or basement working area, and a carriage made of a similar lightweight material and which supports an illuminating device thereon. The carriage is adjustably securable along the length of the frame between its ends, thereby providing means for adjusting the area of illumination between the pivot end and remote end of the frame.

The present invention can also provide a means or mechanism for positively holding the boom assembly at a desired location comprising a catch member extending upwardly from the remote end portion of the boom assembly and a plurality of hook members extending downwardly from the surface to which the swivel is connected, the hook members being in peripheral alignment with the circular path circumscribed by the catch member. The catch member may also be connected to the boom assembly by a flexible member, such as a spring or hard rubber material, to allow the catch member to be flexed away from certain ones of the hook members when moving the boom assembly to the desired position. Thereafter, the catch member is engaged by the hook member to positively hold the boom assembly at the desired location.

The present invention further provides a control line connected to the boom assembly and extending downwardly therefrom and in easy reachable access to the user, thereby permitting the user to easily and conveniently adjust the boom assembly to the desired location.

The present invention still further provides a swivel securely connected to a surface and having one end of the boom assembly pivotally connected thereto for pivoting the boom assembly thereabout in a plane generally parallel to the surface. The swivel is made of a strong material, such as twelve or thirteen gauge steel, and provides a reliable mounting structure for pivoting the boom assembly. The swivel comprises a pair of outer mounting plates having respective grooves generally circularly disposed therein. The plates are mounted together such that the grooves are in direct facing relationship with each other to thereby form a generally circular tubular-like track therebetween. An intermediate plate is disposed between the outer mounting plates and has a plurality of holes generally circularly disposed therethrough and in peripheral alignment with the tubular-like track formed by the mounting plate grooves. A like plurality of ball bearings are disposed in respective ones of he openings in the intermediate plate to provide a bearing surface between the outer mounting plates.

In one form of the invention, there is provided a boom supported light fixture comprising a boom assembly having a pivot end portion and an opposite remote end portion, and a mountable swivel having the pivot end portion pivotally connected thereto for pivoting the boom assembly thereabout, whereby the remote end portion moves along a generally circular path with the swivel as the center thereof. A holding means or mechanism is provided at the remote end portion of the boom assembly for selectively positively holding the remote end portion at any desired point along the path. The remote end portion is adapted to have connected thereto an illuminating device for illuminating areas to which the boom assembly is selectively positioned.

It is an object of the present invention to provide a boom supported light fixture that is lightweight and inexpensive to manufacture and purchase.

Another object of the present invention is to provide a boom supported light fixture that is easily assembled and installed by the user.

Yet another object of the present invention is to provide a boom supported light fixture having a holding means or mechanism at the remote end portion thereof for positively holding the boom assembly at a selected position.

A further object of the present invention is to provide a boom supported light fixture having a control line at the remote end portion for easily and conveniently positioning the boom assembly to a selected area.

A still further object of the present invention is to provide a strong and reliable swivel for connecting the boom assembly thereto.

Further objects of the present invention will appear as the description proceeds.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
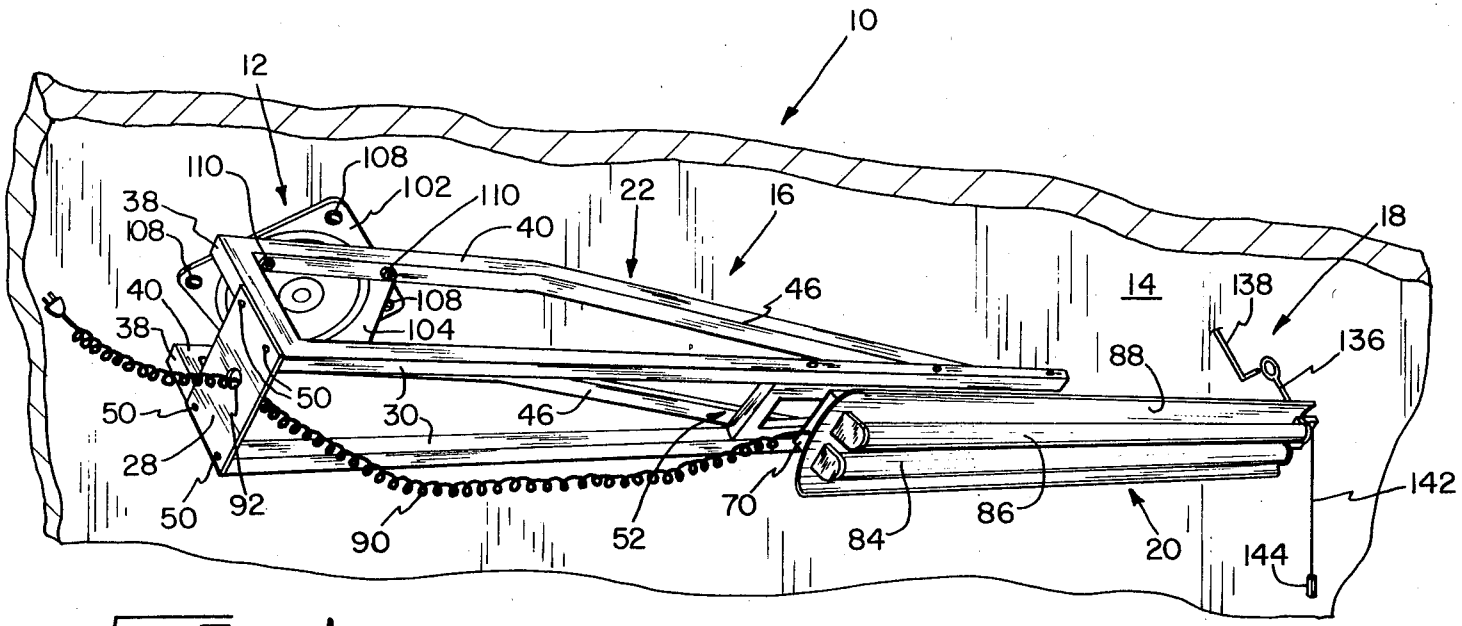
FIG. 1 is a perspective view of one embodiment of the present invention connected to an overhead surface.
Figure 2:
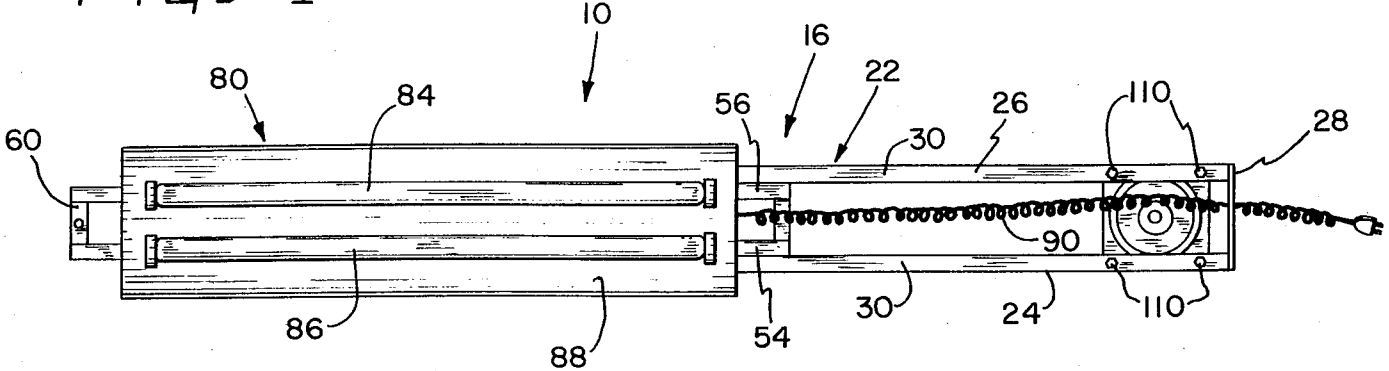
FIG. 2 is a bottom plan view of the embodiment in FIG. 1.

Referring now to the figures and more particularly FIG. 1, boom supported light fixture 10 of the present invention is illustrated generally comprising swivel 12 connected to overhead surface 14, boom assembly 16 pivotally connected to swivel 12, holding mechanism 18 connected to the remote end portion of boom assembly 16, and light fixture 20 also connected at the remote end portion of boom assembly 16. Light fixture 20 is preferrably a fluorescent light bulb, but can also be another type of illuminating device.

Referring more particularly now to FIGS. 1,2,3, and 4, boom assembly 16 includes a frame 22 having a pair of arms 24,26 connected together in spaced apart relation by end plate 28. The connection between plate 28 and arms 24,26 can be made in any suitable manner, such as by bolting. Since each arm is identical, a description of only arm 26 will be made, and like elements of arms 24,26 will have the same reference numerals.

Arm 26 includes a first elongate segment 30 having at one end thereof three spaced-apart holes 32,34,36, and at the other end thereof a second segment 38 extending upwardly therefrom and connected thereto as by welding, for example. A third segment 40 is connected to segment 38, by welding for example, and extends outwardly therefrom in the same plane as and parallel to first segment 30. Third segment 40 further has a pair of spaced-apart openings 42,44 disposed therethrough. A fourth segment 46 of arm 26 is connected to the remote end of segment 40, again as by welding for example, and extends downwardly therefrom, as viewed in FIG. 4, to a top portion 48 of segment 30 and is connected thereto, as by welding for example. Arms 24,26 are made of a strong, lightweight material, such as aluminum, in tubular-like form and, as just described, form a strong, lightweight structure. As earlier mentioned, arms 24,26 are joined together in spaced-apart relation by end plate 28 being bolted to respective segments 38, or by suitable fasteners (not shown) received through openings 50 (FIG. 1) in plate 28 and openings (not shown) in segments 38.

Arms 24,26 are further maintained in a spaced-apart, connected manner by swivel 12 connected to respective segments 40.

Boom assembly 16 further includes a carriage 52 made of a strong, lightweight material, such as aluminum, in tubular-like form. Carriage 52 comprises two relatively elongate members 54,56 connected together in spaced-apart relation by two relatively short members 58,60 connected to the respective end portions of members 54, 56. The connection between members 54-60 can be made in any suitable manner, such as by welding. Again, members 54-60 are made of a strong, lightweight material, such as aluminum in tubular-like form, thereby providing a sturdy, lightweight structure. Members 54,56 are spaced-apart a distance such that carriage 52 easily fits between arms 24,26 with members 54,56 in sliding engagement with arms 24,26, respectively.

Figure 4:
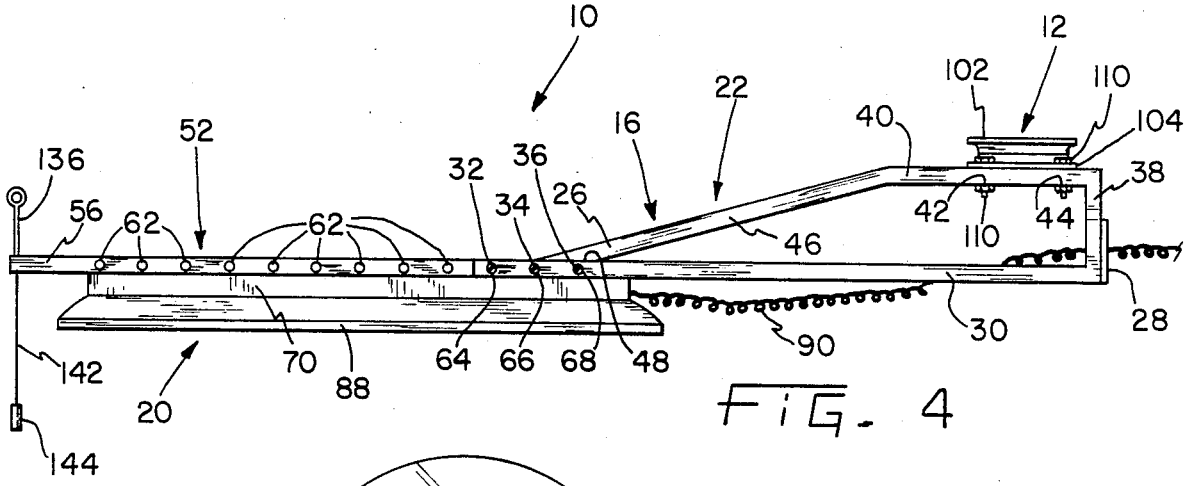
FIG. 4 is a side elevational view of the embodiment in FIG. 1.

Referring now primarily to FIG. 4, members 54,56 have a plurality of openings 62 disposed therethrough, and openings 62 are spaced-apart from one another a distance equal to the distance which separates holes 32,34,36 from one another. This permits carriage 52 to be slidably adjusted along the length of arms 24,26 to a desired position, at which carriage 52 is secured to arms 24,26 by fasteners 64,66,68 received through respective holes 32,34,36 and openings 62.

So far as described, boom assembly 16 comprising frame 22 and carriage 52 provides a sturdy, lightweight structure for supporting light fixture 20 thereon. Referring now to FIGS. 1,2,3, and 4, light fixture 20 comprises housing 70 containing the necessary electrical connections for light fixture 20, and which is connected to carriage 52 by a pair of ribs 72,74 and a pair of fasteners 76,78 received through respective openings 80,82 in ribs 72,74 and openings (not shown) in housing 70. A pair of elongate fluorescent light bulbs 84,86 are electrically connected to housing 70, and a reflective screen 88 is disposed between lights 84,86 and housing 70 to reflect light in a downwardly direction or away from housing 70 and boom assembly 16. Coil type electric line 90 of helical shape leads from housing 70 and through opening 92 in end plate 28 to an electrical source (not shown) for providing electric current to bulbs 84,86. It should now be readily apparent that since light fixture 20 is connected to carriage 52, that any adjustment of carriage 52 along the length of frame 22 likewise adjusts light fixture 20.

Figure 3:
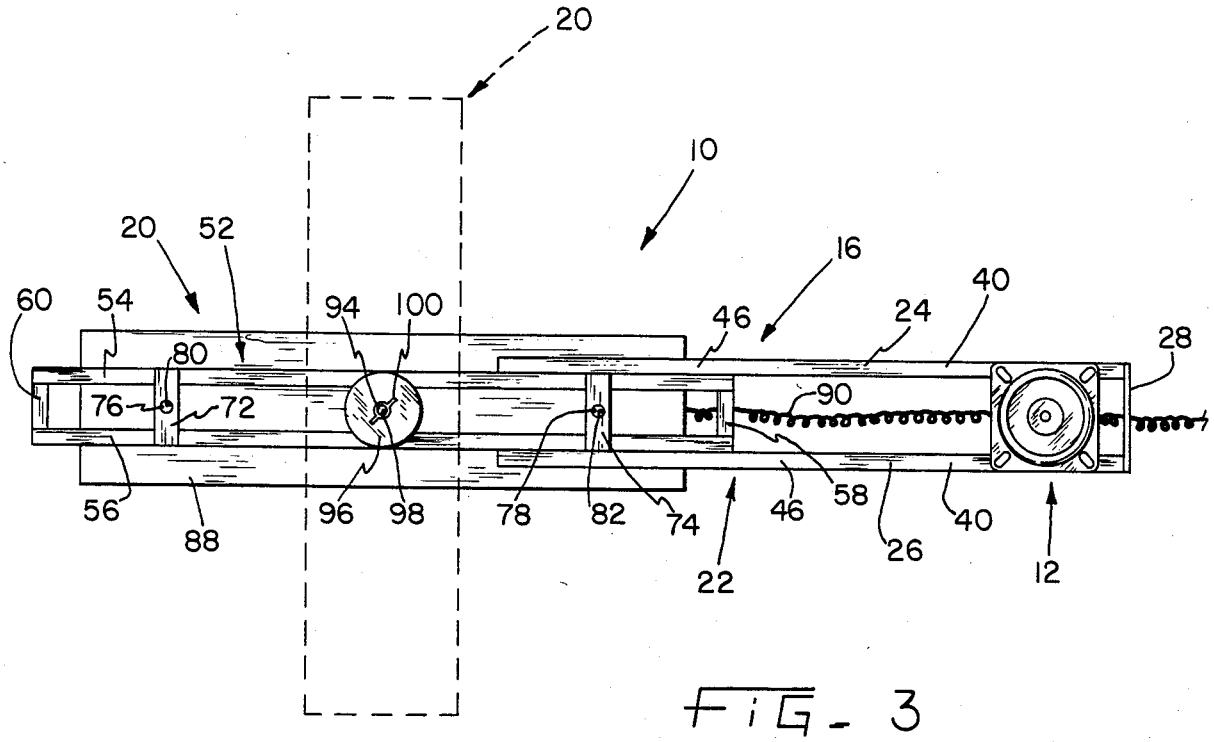
FIG. 3 is top plan view of the embodiment in FIG. 1 and further illustrating in dashed lines one alternate position of the light fixture connected thereto.

Referring to FIG. 3 alone, an alternate means of connecting light fixture 20 to carriage 52 is illustrated wherein threaded bolt 94 is connected to housing 70 and extends upwardly therefrom between members 54,56 of carriage 52. Threaded bolt 94 is received through opening 98 of disk 96, which has a diameter at least greater than the distance between members 54,56, and wing nut 100 is threadedly received on bolt 94 to securely connect light fixture 20 to carriage 52. By loosening wing nut 100, light fixture 20 can be rotated relative to carriage 52 to any desired position, one being indicated in dashed lines. This adjustment of light fixture 20 permits the user to adjust the area being illuminated by lights 84,86.

Figure 8:
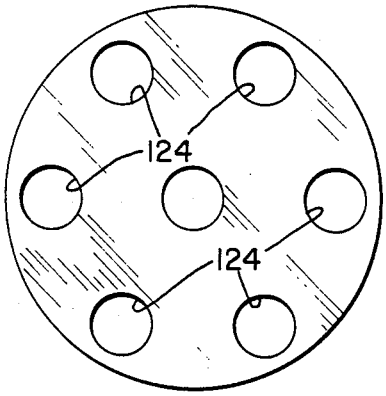
FIG. 8 is a plan view of the bearing plate for the swivel in FIG. 7.
Figure 6:
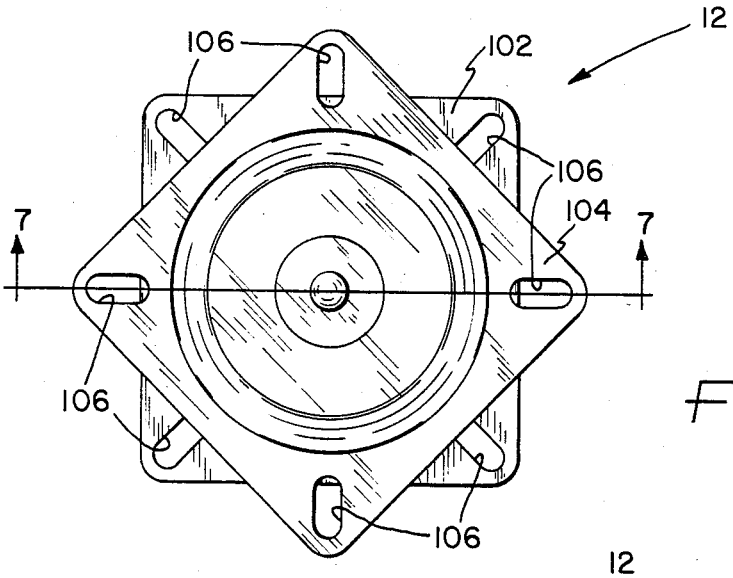
FIG. 6 is a plan view of the swivel for the embodiment in FIG. 1.
Figure 7:
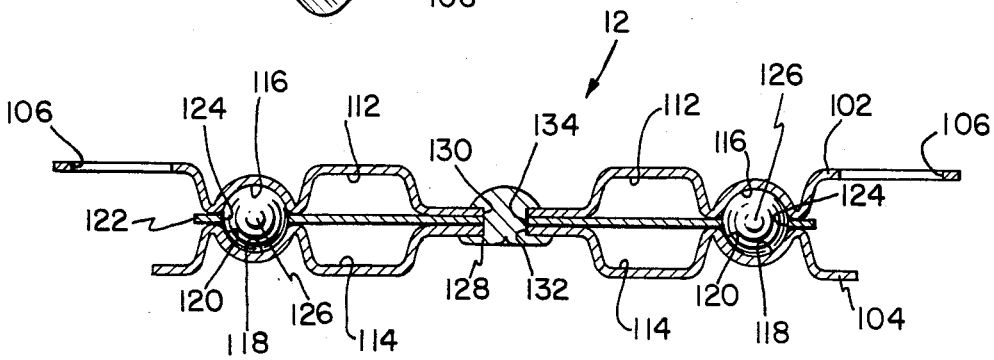
FIG. 7 is a sectional view of FIG. 6 taken along line 7—7 and viewed in the direction of the arrows.

Continuing to refer to the figures and particularly FIGS. 6,7, and 8, swivel 12 comprises two similar mounting plates 102, 104 made of a hard material, such as 12 or 13 gauge steel. Each plate 102, 104 is generally square in shape and has slotted openings 106 in respective corners thereof. Slotted openings 106 of mounting plate 102 can be used to secure swivel 12 to overhead surface 14 by means of mounting screws 108 received through respective openings 106 and secured in overhead surface 14 (FIG. 1). Similarly, mounting plate 104 is secured to respective segments 40 of boom assembly arms 24,26 by means of suitable fasteners, such as nut and bolt assemblies 110 received through respective openings 42,44.

Referring more particularly to FIG. 7, it can be seen that mounting plates 102,104 are impressed with respective circular channels 112,114 and circular grooves 116,118, wherein grooves 116,118 form a circular tubular track 120 therebetween. Circular channels 112,114 and circular grooves 116,118 are formed in respective plates 102,104 to increase the rigidity thereof; tubular track 120 also being used for a purpose hereinafter described. A bearing plate 122 is disposed between mounting plates 102,104 and has a plurality of circularly arrayed openings 124 therethrough (FIG. 8), which are in peripheral alignment with tubular track 120. A like plurality of ball bearings 126 are respectively disposed within respective openings 124 and ride within tubular track 120. Mounting plates 102,104, bearing plate 122, and ball bearings 126 are securely assembled together by pin 128 received through respective holes 130,132, and 134; the head of pin 128 being swaged to complete the assembly of swivel 12. As described, swivel 12 provides a strong and reliable pivotal connection between boom assembly 16 and overhead surface 14. Swivel 12 may be a swivel such as that manufactured by Trendler Metal Products of Chicago, Ill.

Figure 5:
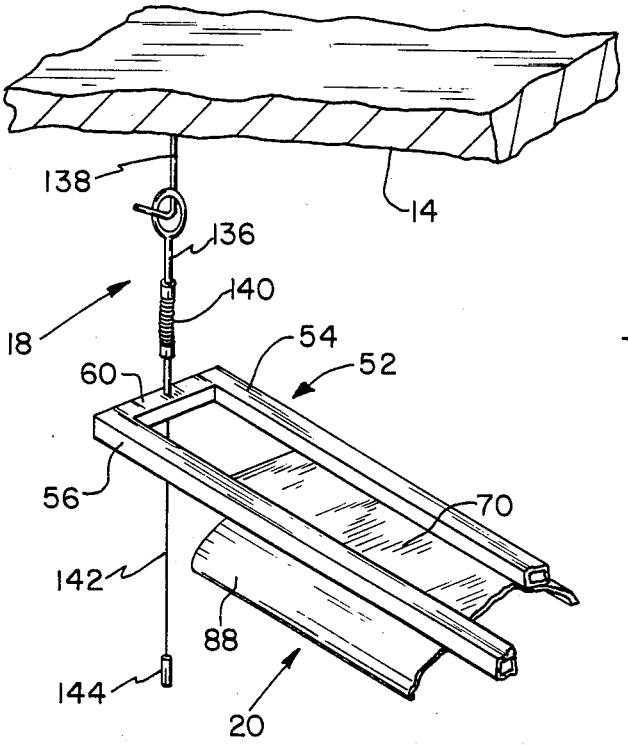
FIG. 5 is an enlarged fragmentary view in perspective of the remote end portion of the embodiment in FIG. 1 illustrating the holding mechanism thereof.

Referring now to FIGS. 1 and 5, holding mechanism 18 comprises a catch member, such as eyebolt 136 connected to member 60 of carriage 52 and extending upwardly therefrom in close proximity to overhead surface 14, and a plurality of hooks 138 connected to overhead surface 14 and extending downwardly therefrom a distance to allow eyebolt 136 to be positively engaged by a selected hook 138, as indicated in FIG. 5. Hooks 138 are arranged in a circular array, and since carriage 52 can be radially adjusted on the length of frame 22, it can be desirable to have other hooks 138 circularly arrayed about swivel 12 at various desired radii therefrom. Alternatively, eyebolt 136 could be connected to the remote end of either arm 24 or 26 or member 60 of frame 22, thereby requiring hooks 138 to be circularly arrayed about swivel 12 at only one radius therefrom.

FIG. 5 also illustrates eyebolt 136 being interconnected to member 60 by a flexible member, such as spring 140. Spring 140 may also be replaced by other flexible members, such as members made of natural rubber or elastomeric material. Spring 140 permits eyebolt 136 to be flexed away from some hooks 138 when boom assembly 16 is being moved to a desired location or position.

To assist the user in moving boom assembly 16 and its attached light fixture 20 to a desired position, a control line 142 is connected to member 60 and extends downwardly therefrom, and may have a handle 144 connected to its remote end. The figures illustrate control line 144 as being somewhat short in length relative to boom assembly 16, but it is to be understood that line 142 may be of any desired length to easily and conveniently allow the user to position light fixture 20. Further, line 142 eliminates any necessity of the user having to maneuver himself about obstacles or other objects to reach boom assembly 16 to move it to a different location or position.

In operation, once swivel 12 has been mounted to a desired overhead surface 14, and coil type electric line 90 has been electrically connected to a source of electric energy to illuminate bulbs 84,86 he then grasps handle 144 of line 142 to position light fixture 20 above a desired working location, above which a hook 138 is secured in overhead surface 14. At this desired location, the user engages eyebolt 136 with hook 138, if desired, hook 138 may be slightly turned to further lock boom assembly 16 in a stationary manner.

With light fixture 20 connected to carriage 52 in the alternate manner by means of disk 96, as illustrated in FIG. 3, the user may rotate light fixture 20 as earlier described above to better illuminate working area. In this alternate method of connecting light fixture 20 to carriage 52, eyebolt 136 is connected to one of the remote end portions of arms 24,26.

Regardless of the method of connection between light fixture 20 and carriage 52, further adjustment in the location or area of illumination can be made by removing fasteners 64,66,68, and radially adjusting carriage 52 along the length of frame 22 to the desired position, and then reinserting fasteners 64,66,68.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A boom assembly for supporting an elongated light fixture, comprising:

an elongated frame including two arms connected together in spaced apart relationship and having a pivot end portion and an opposite remote end portion, a mountable swivel connected to said pivot end portion for pivoting said elongated frame thereabout, whereby said remote end portion is movable in a generally circular path in a plane generally perpendicular to the axis of rotation of said swivel and having said swivel at the center thereof, a carriage adjustably mounted between said two arms at said remote end portion of said frame whereby said carriage is selectively axially adjustable radially outwardly from said swivel;

a holding means secured to said carriage for selectively positively supporting said carriage at any desired point along the circular path, and said carriage adapted to have connected thereto an elongated illuminating device, whereby illumination can be provided at selected areas.

2. The fixture of claim 1 further comprising control means connected to said carriage for controlling the position of said carriage along the circular path.

3. The fixture of claim 2 wherein said control means is a line member connected to said carriage and extending downwardly therefrom.

4. The fixture of claim 1 wherein said swivel comprises:

a mountable first plate member, a second plate member pivotally connected to said mountable first plate member and having said pivot end portion of said elongated frame connected thereto, and a bearing means disposed between said first and said second plate members.

5. The fixture of claim 4 wherein said first and said second plate members have respective generally circular grooves disposed therein, said grooves being in facing relationship with each other to form a generally circular tubular-like track therebetween, and wherein said bearing means is a plurality of ball bearings disposed in said generally circular tubular-like track.

6. The fixture of claim 5 further comprising an intermediate plate member disposed between said first and said second plate members and having a like plurality of openings generally circularly disposed therethrough, said openings being in peripheral alignment with said grooves and having therein respective ones of said ball bearings.

7. The fixture of claim 1 wherein said swivel is connected to a downwardly facing support surface, and wherein said holding means comprises a catch member connected to and extending upwardly from said carriage in close proximity to said downwardly facing support surface, and a plurality of hook members connected to and extending downwardly from said support surface at selected points thereon and being selectively positively engageable by said catch member, whereby said boom assembly can be held in a selected position by said catch member being moved into positive engagement with a selected one of said hook members.

8. The fixture of claim 7 wherein said catch member is interconnected to said remote end portion by a flexibly resilient member, thereby allowing said catch member to be easily flexed away from certain one of said hook members while moving said elongated frame to a desired position.

9. A swivelable boom supported lighting apparatus, comprising:

an elongated illuminating device;

a boom assembly comprising an elongated frame including two arms connected together in spaced apart relationship and having a pivot end portion and an opposite remote end portion, a swivel having said frame pivot end portion pivotally connected thereto for pivoting said boom assembly thereabout, whereby said remote end portion is pivotable along a generally circular path in a plane generally perpendicular to the axis of rotation of said swivel and having said swivel at the center thereof, a carriage adjustably mounted between said two arms at said remote end portion of said frame whereby said carriage is selectively axially adjustable radially outwardly from said swivel, said elongated illuminating device secured to said carriage, and said swivel comprising a mountable first plate member, a second plate member pivotally connected to said mountable first plate member and having said pivot end portion of said elongated frame connected thereto, and a bearing means disposed between said first and said second plate members.

10. The apparatus of claim 9 further comprising a holding means secured to said carriage for selectively supporting said remote end portion at any desired point along the path traveled thereby.

11. The apparatus of claim 10 wherein said first plate member is connected to a support surface, and wherein said holding means comprises a catch member connected to and extending outwardly from said carriage in close proximity to said support surface, and a plurality of hook members connected to and extending outwardly from said support surface at selected points thereon and being selectively positively engageable by said catch member, whereby said boom assembly can be held in a selected position by said catch member being moved into positive engagement with a selective one of said hook members.

12. The apparatus of claim 11 wherein said catch member is flexibly attached to said carriage to allow said catch member to be easily flexed away from certain ones of said hook members while moving said boom assembly to a desired position.

13. The apparatus of claim 9 wherein said first and said second plate members have respective generally circular grooves disposed therein, said grooves being in facing relationship with each other to form a generally circular tubular-like track therebetween, and wherein said bearing means is a plurality of ball bearings disposed in said generally circular tubular-like track.

14. The apparatus of claim 13 further comprising an intermediate plate member disposed between said first and said second plate members and having a like plurality of openings generally circularly disposed therethrough, said openings being in peripheral alignment with said grooves and rotatably containing therein respective ones of said ball bearings.

15. The apparatus of claim 9 further comprising control means connected to said remote end portion of said boom assembly for controlling the position of said frame remote end portion along the circular path.

16. The apparatus of claim 9 wherein said elongate illuminating device is pivotally adjustable on said carriage between a first position wherein said generally elongate illuminating device is aligned with a longitudinal axis of said boom assembly and a second position wherein said generally elongate illuminating device is perpendicular to the longitudinal axis of said boom assembly.

17. The apparatus of claim 9 wherein said elongated illuminating device is a fluorescent light fixture. 1

* * * * *